US008210787B2

(12) United States Patent
Rygol

(10) Patent No.: US 8,210,787 B2
(45) Date of Patent: Jul. 3, 2012

(54) COVER FEEDING DEVICE FOR A BOOK BINDING MACHINE

(75) Inventor: Dirk Rygol, Osnabrück (DE)

(73) Assignee: Kolbus GmbH & Co. KG, Rahden (DE)

( * ) Notice: Subject to any disclaimer, the term of this patent is extended or adjusted under 35 U.S.C. 154(b) by 889 days.

(21) Appl. No.: 11/897,497

(22) Filed: Aug. 30, 2007

(65) Prior Publication Data

US 2008/0063492 A1 Mar. 13, 2008

(30) Foreign Application Priority Data

Sep. 7, 2006 (DE) ..... 10 2006 042 102

(51) Int. Cl.

| | |
|---|---|
| ***B42D 1/00*** | (2006.01) |
| ***B42D 3/00*** | (2006.01) |
| ***B42D 15/00*** | (2006.01) |
| ***B42C 9/00*** | (2006.01) |
| ***B42C 11/00*** | (2006.01) |
| ***B42B 5/00*** | (2006.01) |

(52) U.S. Cl. ..... 412/19; 281/15.1; 281/21.1; 281/29; 283/63.1; 283/64; 412/1; 412/4; 412/6; 412/9; 412/33

(58) Field of Classification Search ..... 281/3.1, 281/4, 15.1, 17, 19.1, 21.1, 29, 51; 283/63.1, 283/64, 117; 412/1, 4, 6, 9, 18, 19, 33
See application file for complete search history.

(56) References Cited

U.S. PATENT DOCUMENTS

| | | | | |
|---|---|---|---|---|
| 2,962,733 | A * | 12/1960 | Kramer et al. | 412/9 |
| 5,988,620 | A * | 11/1999 | Graushar | 412/19 |
| 6,119,753 | A * | 9/2000 | Begemann et al. | 412/19 |

FOREIGN PATENT DOCUMENTS

| | | |
|---|---|---|
| DE | 30 06 266 A1 | 9/1981 |
| DE | 100 24 068 A1 | 8/2001 |
| DE | 20 2005 007 012 U1 | 9/2005 |
| GB | 2 351 467 A | 1/2001 |

* cited by examiner

*Primary Examiner* — Edward Tolan
*Assistant Examiner* — Justin Lewis
(74) *Attorney, Agent, or Firm* — Alix, Yale & Ristas, LLP

(57) ABSTRACT

A cover feeding device for a book binding machine features a transport device for feeding covers (1) decollated from a magazine (11), a conveyor (12) that is arranged underneath the plane of motion of the book blocks (7) a pressing device (14) that presses the covers against the spine and a printing unit (17) that prints content (8) onto the cover (1). The transport device comprises a turning device (21, 31*a*, *b*, 41) for transporting the covers (1) such that the outside (3) is at least partially directed upward during their infeed, and the printing unit (17) is arranged above the cover transport.

20 Claims, 3 Drawing Sheets

COVER FEEDING DEVICE FOR A BOOK BINDING MACHINE

BACKGROUND

The present invention pertains to a cover feeding device for a book binding machine.

In the personalization of brochures produced on adhesive binders, personal data such as, for example, an address is printed on the covers shortly before they are combined with the book blocks.

The arrangement of the printing unit underneath the cover conveyor makes it possible to print the outside of the covers, for example, with an individual barcode for tracking personally compiled printed products until the production process is completed. The printed barcodes can be read at the entry of downstream processing devices so as to individually process the products, e.g., to insert additional personal contents into the printed product. The detection of the barcode at the end of the production process makes it possible to ensure that the respective personal printed product was actually produced.

The printing units used for this purpose frequently consist of digitally controlled inkjet printing heads in which the ink or printing color is transferred onto the cover in the form of extremely small droplets. However, a reliable printing process and a flawless performance of these printing heads cannot be ensured if the printing process is carried out from the bottom, namely because the printing heads are soiled by falling paper dust. Another problem is the ink receptivity of the usually finished cover surface. Back-dropping printing colors cause the print quality to deteriorate. In addition, the covers cannot be guided again within the printed region until the applied printing color has dried. The range of cover formats, as well as the positioning of the printed information, is significantly restricted if the printing process is carried out from the bottom and the printing head is positioned between the conveying means of the cover conveyor.

SUMMARY

The present invention is based on the objective of developing a cover feeding device for a book binding machine which makes it possible to print the outside of covers decollated from the magazine from the top.

This objective is attained in that the transport device for the decollated covers features a turning device that makes it possible to transport the covers such that the outside thereof is at least partially directed upward during their infeed. The printing device for printing the outside of the covers can then be arranged above the cover transport so as to achieve the advantages of significantly reduced soiling of the printing unit with paper dust and a substantially improved transfer of the printing color or ink onto the cover surface, namely because the weight of the droplets no longer counteracts the ink receptivity.

According to one practical embodiment, a transport section for drying the printed covers is arranged directly downstream of the printing unit, wherein the printed surface of the covers is not contacted by any guiding and/or conveying means of the transport device in this drying section.

According to one preferred additional development, the turning device comprises a clamping conveyor for the covers such that a positionally accurate transport of the covers and therefore the exact printing thereof can be realized. It is advantageous that the clamping conveyor for the covers consists of a pair of belts that take hold of the covers within the spine region such that the outside of both cover sections remains exposed for the printing process.

In a first embodiment the turning device is realized in the form of a turning conveyor with a pair of belts that are twisted relative to one another along the longitudinal axis. In this case, the complete cover is turned about a longitudinal axis that extends parallel to the transport direction. The turning conveyor may be designed for turning the covers once by 180°. The covers are decollated from the magazine such that the outside is situated on the top in this case. The covers are printed from the top and subsequently turned into the correct position for being joined with the book blocks by 180°. The temporary turning of the covers can be realized in the form of a two-stage intermittent turning process, in which the covers are respectively turned by approximately 180°, or in the form of a forwardly and rearwardly directed turning process, in which the covers are respectively turned by respectively more than 90°. In such temporary turning processes, the covers are decollated from the magazine with the outside situated on the bottom, wherein the covers are turned by more than 90° in order to be printed from the top and then turned back or additionally turned after the printing color has dried.

In a second embodiment the turning device is composed of guiding means for temporarily folding over at least one side of the cover by more than 90°. In this case, the covers are conventionally transported with the outside situated on the bottom. Only the side of the cover to be printed is folded over, wherein a cover that is folded over by slightly more than 90° can already be printed in accordance with the invention because the printing direction has a component in the direction of the gravitational force.

In a third embodiment of the invention the turning device is realized in the form of a looping conveyor. The printing unit is preferably arranged in the region of the upper summit of the looping. The downstream transport section up to the actual infeed transport plane is used as the drying section in this case.

BRIEF DESCRIPTION OF THE DRAWINGS

Exemplary embodiments of the inventive cover feeding device are described in greater detail below with reference to the figures. In these schematic perspective representations.

DETAILED DESCRIPTION

Figure 1:
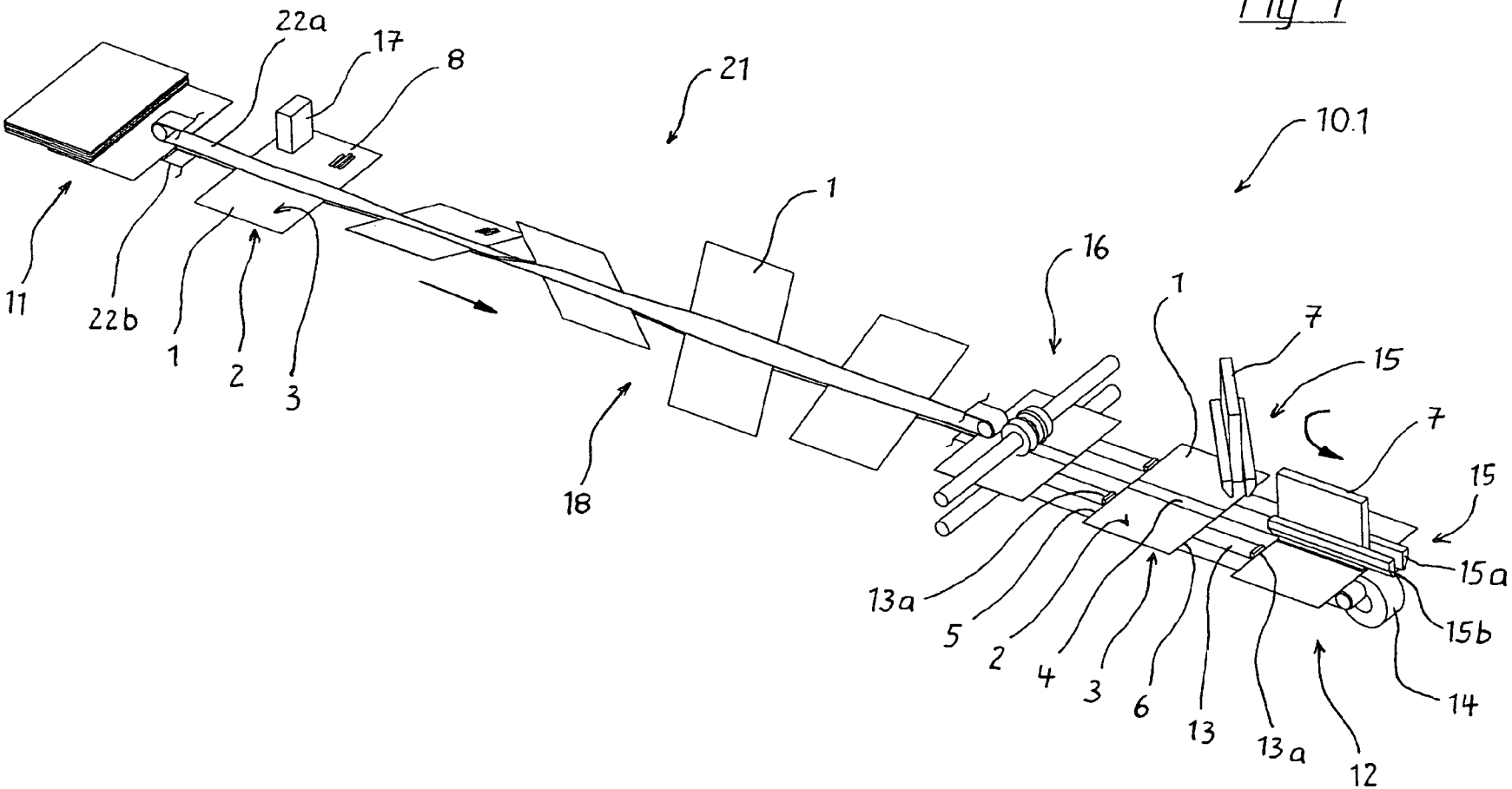
FIG. 1 shows a first embodiment of a cover feeding device with a 180° turning conveyor.
Figure 2:
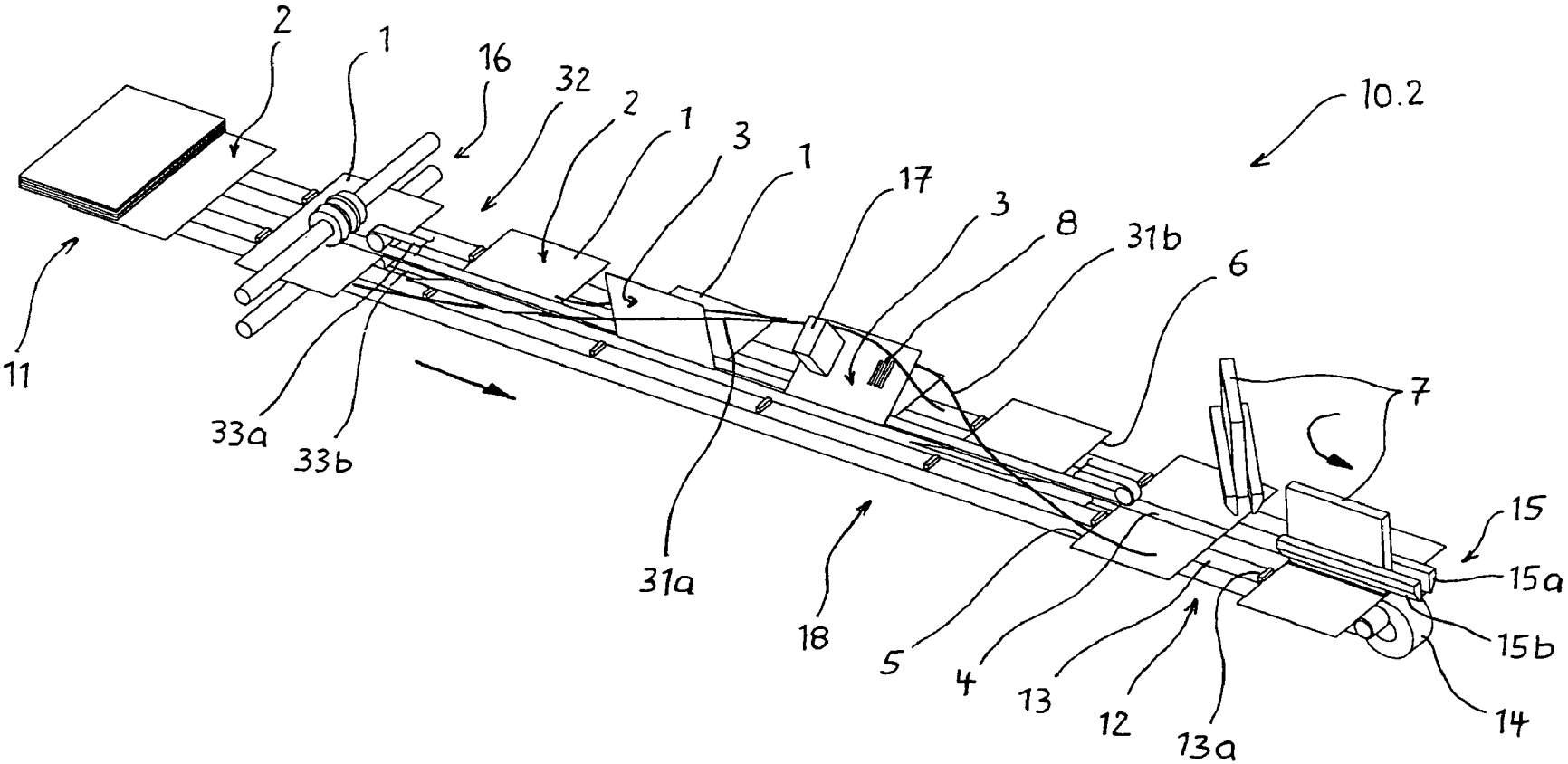
FIG. 2 shows a second embodiment of a cover feeding device with a turning device that is composed of guiding means.
Figure 3:
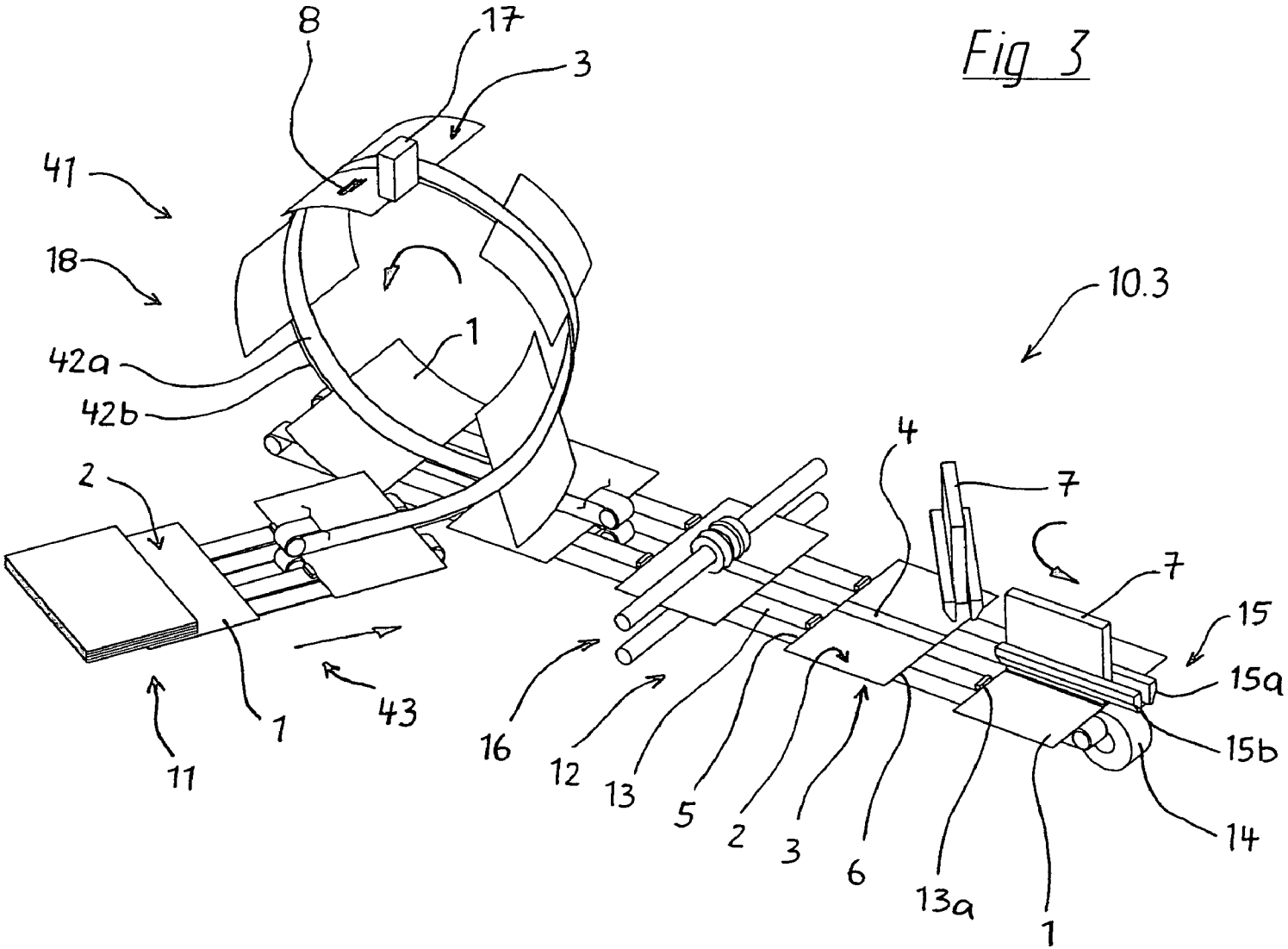
FIG. 3 shows a third embodiment of a cover feeding device with a looping conveyor.

The cover feeding devices 10.1, 10.2 and 10.3 illustrated in FIGS. 1 to 3 are respectively provided for an adhesive binder, the book block transport system of which features a plurality of book block clamps 15 that can be continuously moved along a closed path, wherein only two book block clamps 15 are illustrated in FIGS. 1 to 3 in order to provide a better overview. The book block clamps 15 respectively consist of an inner clamping jaw 15 *a* and an outer clamping jaw 15 *b* for laterally clamping a book block 7 such that a downwardly directed spine overhang remains exposed.

During their circulation, the book blocks 7 are initially processed on the spine and provided with glue on the spine and lateral surfaces near the spine. At the end of a curve in the closed path, the covers 1 are fed in a positionally accurate fashion and pressed against the spine and, if applicable, against the lateral regions of the book block 7. In order to provide a better overview, FIGS. 1 to 3 only show a pressing roller 14 of this pressing device which serves for initially pressing the cover 1 against the spine of the book block 7.

In these cover feeding devices 10.1, 10.2 and 10.3, the covers 1 are stored in magazines 11. After the cyclic decollation of the covers, they are transferred to a transport device in order to be fed to the respective book blocks 7. During this process, the covers pass through a scoring device 16 for producing bending points. The number and the design of the scores depend on the type of brochure. The inner spine scores define a spine region 4 of the cover 1 that is glued to the block spine.

The transport device for the covers 1 comprises a cover conveyor 12 with two adjacently arranged endless conveying means 13 that are provided with pushers 13 *a* for pushing the covers 1 forward within fixed cycle intervals.

The book blocks 7 are transported such that the spine region 4 is directed downward in the adhesive binder, where the covers 1 need to be fed with the inside 2 situated on the top. Consequently, the outside 3 lies on the bottom during the joining with the book block 7. The head 5 of the cover 1 is situated at the rear and the foot 6 forms the leading end referred to the transport direction.

A printing unit in the form of an inkjet printing head 17 is provided in the cover feeding device in order to print the covers 1, for example, with an address 8. In the embodiments of the invention illustrated in the figures, the inkjet printing head 17 is arranged above the cover transport.

In order to print the outside 3 of the cover that lies on the bottom when the cover is joined with the book block 7, the cover transport device is respectively provided, according to the invention, with a turning device 21, 31*a, b* and 41 such that at least the region of the outside 3 of the cover to be printed is directed upward during the printing process and consequently can be printed from the top.

A first embodiment illustrated in FIG. 1 features a turning conveyor 21 with two conveyor belts 22*a, b* that are twisted relative to one another along the longitudinal axis and between which the covers 1 are clamped. This arrangement makes it possible to turn the covers 1 by 180°. The covers 1 are therefore fed into the magazine 11 with the outside 3 lying on the top. Immediately after the decollation, the outside 3 of the covers can be printed from the top by means of the inkjet printing head 17. Subsequently, the covers 1 are returned into the correct position for being joined with the book blocks 7 and transferred to the cover conveyor 12 in order to be fed to the respective book blocks 7 in a positionally accurate fashion.

The turning conveyor 21 could also be realized in the form of a 360° turning conveyor such that the covers 1 are conventionally fed with the outside 3 situated on the bottom. In this case, the printing is carried out approximately in the center of the turning process while the outside 3 is directed upward. It would also be conceivable to utilize a turning conveyor that initially turns the covers by an angle that lies between slightly more than 90° and no more than 180° and turns the covers back into their primary position after the printing process.

A second embodiment illustrated in FIG. 2 features guiding means in the form of guide rods 31*a, b* that serve for temporarily folding over at least one section of the cover 1 that needs to be printed on the outside 3. In this case, a clamping conveyor 32 that is composed of conveyor belts 33*a, b* transports the covers 1 in a clamped fashion such that their outside 3 is situated on the bottom, wherein at least the section of the cover to be folded over remains exposed. A cover that is folded over by more than 90° can already be printed from the top in accordance with the present disclosure. The above-described advantages are attained as soon as the printing direction of the inkjet printing head 17 has a downward component extending in the direction of the gravitational force.

FIG. 3 shows a third embodiment, which features a turning device in the form of a looping conveyor 41, in which the covers 1 are clamped by means of conveyor belts 42*a, b*, wherein the covers 1 are essentially turned by 360° about an axis of rotation extending parallel to the head and food edges. In the embodiment shown, a feed conveyor 43 feeds the decollated covers 1 to the looping conveyor 41 transverse the cover transport direction. At the exit of the looping conveyor 41, the covers 1 are transferred to the cover conveyor 12 known from the other embodiments in order to be fed to the book blocks 7.

The inkjet printing head 17 is approximately arranged at the summit of the looping conveyor 41. The downstream transport section up to the transfer of the covers 1 to the cover conveyor 12 is used as the drying section in this embodiment.

As another preferred feature applicable to all embodiments as shown in FIGS. 1-3, a section of the transport device that is situated directly downstream of the printing unit 17 conveys the printed cover for air drying the print as at 18, without contacting the printed surface of the cover with guiding and/or conveying means of the transport device.

The invention claimed is:

1. A device for feeding brochure covers in an adhesive binding machine having book block clamps for engaging sides of book blocks above respective downward facing book block spines, and continuously moving the book blocks with the downward facing spines on a plane of motion to a pressing position, comprising:

a scoring device for scoring each brochure cover and thereby producing a cover spine region between score lines;

a pressing device that receives the scored brochure covers with a cover inside facing upward and a cover outside facing downward, and at the pressing position with the spine region of the covers below the spine of the books, presses the inside of the spine region of said covers upwardly against the book block spine while the sides of the book block are clamped;

a transport device for feeding covers decollated from a magazine, including a conveyor that is arranged underneath the plane of motion of the book block spines, pushers for engaging the cover from behind and feeding the scored covers to the pressing position of the book blocks at the pressing device, and a cover turning device upstream of the pressing device such that the outside of the brochure covers faces at least partially upward during their infeed and then faces downward before reaching the pressing device; and a printing unit that prints content onto the outside of the cover, located above the transport device.

2. The cover feeding device according to claim 1, wherein a section of the transport device that is situated directly downstream of the printing unit conveys the printed cover for air drying the print, without contacting the printed surface of the cover with guiding and/or conveying means of the transport device.

3. The cover feeding device according to claim 1, wherein the turning device comprises a clamping conveyor for the covers.

4. The cover feeding device according to claim 2, wherein the turning device comprises a clamping conveyor for the covers.

5. The cover feeding device according to claim 3, wherein the covers are clamped by a pair of conveyor belts at the cover spine region.

6. The cover feeding device according to claim 1, wherein the turning device comprises a turning conveyor with a pair of longitudinally extending belts that are twisted relative to one another along the longitudinal axis.

7. The cover feeding device according to claim 1, including said magazine and wherein the turning device turns the covers that are decollated from the magazine once, by an angle of 180°.

8. The cover feeding device according to claim 1, wherein the turning device temporarily turns the covers twice in a quasi intermittent fashion, by an angle of respectively 180°.

9. The cover feeding device according to claim 1, wherein the turning device temporarily turns the covers twice, forward and backward, by an angle of more than 90°.

10. The cover feeding device according to claim 1, wherein the turning device is composed of guiding means for temporarily folding over at least one section of the cover on either side of the spine region by more than 90°.

11. The cover feeding device according to claim 1, wherein the turning device is a looping conveyor.

12. The cover feeding device according to claim 11, wherein the printing unit is arranged approximately at the upper limit of the looping conveyor.

13. The cover feeding device according to claim 3, including said magazine and wherein the turning device turns the covers that are decollated from the magazine once, by an angle of 180°.

14. The cover feeding device according to claim 3, wherein the turning device temporarily turns the covers twice in a quasi intermittent fashion, by an angle of respectively 180°.

15. The cover feeding device according to claim 3, wherein the turning device temporarily turns the covers twice, forward and backward, by an angle of more than 90°.

16. The cover feeding device according to claim 3, wherein the turning device is composed of guiding means for temporarily folding over at least one section of the cover on either side of the spine region by more than 90°.

17. The cover feeding device according to claim 3, wherein the turning device is a looping conveyor.

18. The cover feeding device according to claim 5, wherein the turning device comprises a turning conveyor with a pair of longitudinally extending belts that are twisted relative to one another along the longitudinal axis.

19. The cover feeding device according to claim 5, wherein the turning device is composed of guiding means for temporarily folding over at least one section of the cover on either side of the spine region by more than 90°.

20. The cover feeding device according to claim 5, wherein the turning device is a looping conveyor.

* * * * *